United States Patent [19]

Nederman

[11] 4,259,897

[45] Apr. 7, 1981

[54] DEVICE FOR RECEPTION OR DELIVERY OF GASES

[76] Inventor: Bill P. P. Nederman, Halalid 3, Helsingborg, Sweden

[21] Appl. No.: 970,092

[22] Filed: Dec. 15, 1978

[30] Foreign Application Priority Data

Dec. 16, 1977 [SE] Sweden ..... 7714341

[51] Int. Cl.[3] ..... B08B 15/02; F24F 07/04

[52] U.S. Cl. ..... 98/40 DL; 98/115 R; 126/299 D

[58] Field of Search ..... 137/560; 98/40 DL, 115 R, 98/115 DL, 115 LH, 115 VM; 362/294, 312

[56] References Cited

U.S. PATENT DOCUMENTS

| | | | |
|---|---|---|---|
| 300,329 | 6/1884 | Spearman | 137/560 |
| 3,193,001 | 7/1965 | Meckler | 98/40 DL |
| 3,299,797 | 1/1967 | Dry | 98/40 DL |
| 3,310,672 | 3/1967 | Bursell | 98/40 DL |
| 3,785,271 | 1/1974 | Joy | 98/40DL |
| 3,870,874 | 3/1975 | Larson | 362/294 X |

*Primary Examiner*—Daniel M. Yasich

*Attorney, Agent, or Firm*—Schwartz, Jeffery, Schwaab, Mack, Blumenthal & Koch

[57] ABSTRACT

Disclosed is an apparatus for conveying gases into or out of a specific area while at the same time providing illumination for the area. A lamp housing is adjustably mounted in a cap which is attached to the free end of a gas conveying pipe. The cap widens from a relatively small cross section area to a substantially larger cross section area with the lamp housing movable at least between a position in which it completely blocks flow through the small cross-sectional area of the cap and a position which, while still completely within the confines of the cap, permits the flow of gas therethrough. Specific embodiments of the invention include one in which the adjustable mount is controllable from outside the cap permitting ease of gas flow adjustment therethrough. Because the lamp housing is entirely contained within the cap, it is protected from inadvertent damage during careless handling in its vicinity.

8 Claims, 2 Drawing Figures

DEVICE FOR RECEPTION OR DELIVERY OF GASES

The present invention relates to a device for reception or delivery of gases, such as flue gases, from an area mingled with gases, for instance a welding place, and having at least one gas conveying pipe, the free end of which can be positioned in relation to the area mingled with gas in order to receive or deliver the gases into or from at least one gas conveying conduit being part of the gas conveying pipe, the device further having at least one lighting device to illuminate an area and/or objects at the gas conveying pipe.

Gas conveying devices with adjustable gas conveying pipes generally have a damper means for control of the gas current through the gas conveying pipe. However, if the gas conveying device is provided with a lighting means it is inconvenient to apply a conventional damper device because such a device either will be in the way of the lighting means or be difficult of access due to the lighting means.

The purpose of the present invention is to eliminate this disadvantage, and in the main this is obtained in that the lighting device is formed as a damper which is adjustable to alter the flow passage of the gas conveying channel.

Figure 1:
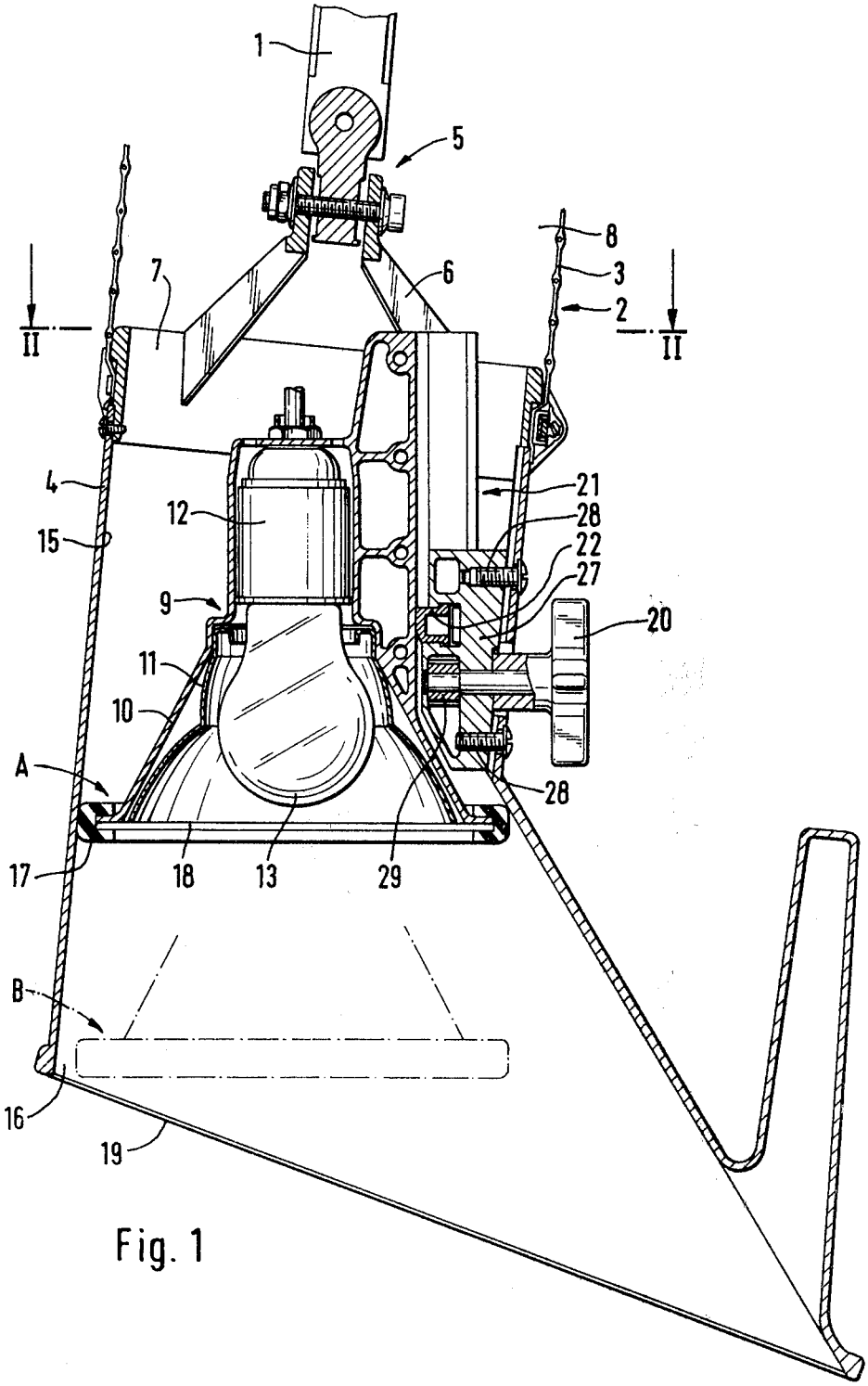
Figure 2:
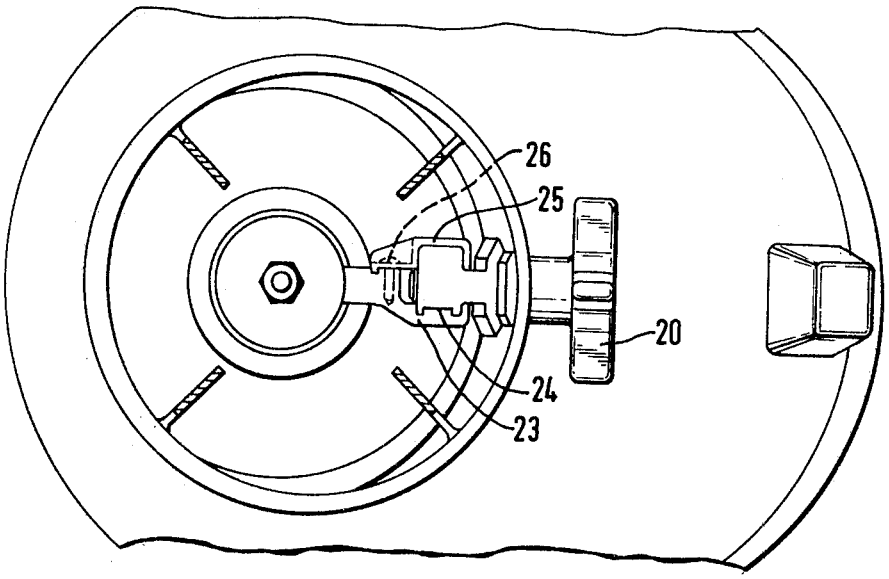

The invention below will be more exactly described with reference to the accompanying drawings in which FIG. 1 is a sectional view of a gas discharging device, and FIG. 2 is a section on the line II—II of FIG. 1.

The gas conveying device illustrated in the drawings have one or more supporting arms 1 which are fixedly or flexibly anchored to a fastening device (not shown) which preferably is mounted on the wall of a workshop. The arm 1 is mounted within a gas conveying pipe 2 which in the illustrated embodiment consists of a tube 3 and an intake or delivery cap 4 connected therewith. The tube 3 preferably consists of a ductile material, for instance rubber material, and the cap 4 preferably consists of a rigid plastic material. The end of the arm 1 is connected with the tube 3 at its union with the cap 4 by means of a joint 5, stays 6 extending from the joint and a ring 7 mounted on the stays.

The present gas conveying device is particularly adapted to carry off flue gases from a welding place (not shown), the cap 4 being positioned at a suitable distance and in a suitable position in relation to the work place. Owing to the fact that the position of the arm 1 can be manually altered the device may be easily adjusted or reversed according to requirement. Alternatively it is possible to provide the device with fixedly mounted arms so that it will be retained in a predetermined position without possibility of being moved from this position unless the arms are dismounted. Such a design, however, has a reduced flexibility and is therefore generally less suitable.

The gas conveying channel 8 of the gas conveying pipe 2 preferably communicates with a gas suction device (not shown) which preferably consists of a fan which can be anchored to the fastening device of the arm 1 or in the vicinity thereof. The gas suction device is dimensioned to create a more or less powerful suction effect in the gas conveying channel 2.

In order to illuminate the area at the gas discharging device and/or objects within or adjacent this area a lighting device 9 is provided which in the main consists of a lamp house 10, a reflector 11 mounted therein, a lamp socket 12 and a bulb 13 screwed into the socket.

In order to make it possible to control the gas current through the gas conveying channel 8 notwithstanding the lighting device and without causing mounting or repair problems the lighting device is formed as a damper which is adjustably mounted in order to alter the flow area of the gas conveying conduit 8. The lighting device 9 forming the damper is remainingly adjustable into at least one position A closing the gas conveying channel 8 and at least one position B opening the gas conveying channel 8 and various intermediate postitions.

The damper/lighting arrangement will be particularly simple and the suction effect at the outer portions of the mouth area (in the illustrated embodiment in the vicinity of the walls of the cap 4) will be particularly good if the lighting device 9 forming the damper is mounted within the gas conveying channel 8 and together with the inside 15 of the gas conveying channel 8 forms a gas flow clearance 16 surrounding the lighting device 9. An effective seat for the lighting device forming the damper is obtained in a simple way in that damper forming portions 17, 18 of the lighting device 9 are located in the widening suction cap 4.

In order to provide an effective damper function without an effect obstructing the illumination the portions forming the damper preferably consists of at least one light transmitting element 18 which seals at least one opening of a lamp house 10 widening towards the same, and partly at least one sealing element 17, surrounding the lamp house 10 at the opening thereof, said element being adapted to sealingly bear against the inside 15 of the gas conveying channel 8 when the channel is closed. The sealing element 17 preferably is shaped as a sealing ring 17 which firmly secures the light transmitting element 18 to the lamp house.

The lighting device 9 forming the damper preferably is operated by means of a control 20 over a rack mechanism 21 mounted in the gas conveying channel 8. The rack mechanism 21 consists of a rack 23 with teeth 24. On the rack 23 is mounted a clamp 25 by means of fastening screws 26. The rack 23 and the clamp 25 grasp over a holder 27 mounted on the suction cap 4 by means of screws 28. The control 20 is connected with the holder 27 and is provided with a gear wheel 29, the teeth of which engage with the teeth 24 of the rack 23 so that the lighting device 9 forming the damper can be moved in relation to the holder 27 by rotation of the control 20. The holder may be provided with a friction element 22 the one end of which bears against the rack 23 so that the friction element 22 assists in retaining the lighting device 9 in is adjusted position. The rack mechanism 21 preferably is mounted in the gas conveying channel 8 immediately within a widening portion thereof.

The device mentioned above and illustrated in the drawings intends to describe the principle of the invention which can be varied within the scope of the following claims at which the device for instance may be provided with more than one gas conveying pipe, more than one gas suction means, more than one gas conveying channel, more than one lighting device etc. Finally, the control 20 for the adjustment of the lighting device 9 forming the damper and a switch for the operation of the light source 13 of the lighting device 9 are mounted on the outside of the gas conveying pipe at the free end 4 thereof. The gas conveying means of course also is suitable for a supply of gas to an area in which a gas supply, for instance, fresh-air supply, is required.

The gas conveying device of course also may have at least one gas exhausting channel and at least one gas supply channel.

I claim:

1. An apparatus for conveying gases as well as illuminating a specific area, said apparatus comprising:

a variable volume gas conveying pipe having at least one free end, said free end positionable by support means in said area;

a cap having a small end connected to said free end of said pipe and which widens to a cross section larger than said pipe;

lamp means for illuminating said area, said lamp means including a lamp housing, said housing having a cross section substantially similar to the free end of said pipe; and means for adjustably mounting said lamp means in said free end of said pipe, said mounting means including means for externally adjusting the position of said lamp means at least between two positions, in one of which at least a portion of the lamp housing sealingly blocks the small end of said cap and prevents the flow of gas therethrough, and in the other of which the lamp housing unblocks the small end of said cap and permits the flow of gas therethrough, said mounting means locating said lamp means wholly within said cap in either of said positions.

2. The apparatus according to claim 1, wherein said lamp means includes:

a light transmitting element closing said lamp housing; and a sealing element mounted on a perimeter of said lamp housing to sealingly bear against said cap in said one of said at least two positions.

3. The apparatus according to claim 2, wherein said sealing element comprises means for mounting said light transmitting element to said lamp housing.

4. The apparatus according to one of claims 1-3, wherein said lamp means includes a light source and said adjusting means includes a switch for controlling the operation of said light source.

5. The apparatus according to one of claims 1-3, wherein said adjusting means comprises a rack mechanism and an external control means for the operation of said rack mechanism.

6. The apparatus according to claim 5, wherein said adjusting means includes a friction element for retaining the rack mechanism in an adjusted position thereof.

7. The apparatus according to claim 5, wherein said rack mechanism is located within said cap.

8. The apparatus according to claim 1, wherein said mounting means mounts said lamp means and said externally adjusting means on said cap which in turn is mounted in said free end of said pipe.

* * * * *